US009437987B1

(12) United States Patent
Yang

(10) Patent No.: US 9,437,987 B1
(45) Date of Patent: Sep. 6, 2016

(54) CONNECTING STRUCTURE FOR EARPHONE

(71) Applicant: M2 Technology, Inc., New Taipei (TW)

(72) Inventor: Chun-Yao Yang, New Taipei (TW)

(73) Assignee: M2 Technology, Inc., New Taipei (TW)

( * ) Notice: Subject to any disclaimer, the term of this patent is extended or adjusted under 35 U.S.C. 154(b) by 0 days.

(21) Appl. No.: 14/795,067

(22) Filed: Jul. 9, 2015

(51) Int. Cl.
*H01R 13/504* (2006.01)
*H01R 24/58* (2011.01)
*H01R 107/00* (2006.01)

(52) U.S. Cl.
CPC ..... *H01R 24/58* (2013.01); *H01R 2107/00* (2013.01)

(58) Field of Classification Search
CPC ..... H01R 13/53; H01R 2107/00
USPC ..... 439/668–669, 680
See application file for complete search history.

(56) References Cited

U.S. PATENT DOCUMENTS 5,641,310 A * 6/1997 Tiberio, Jr. ..... H01R 13/625 439/680
7,666,028 B2 * 2/2010 Meleck ..... H01R 13/6272 439/502
2004/0157499 A1 * 8/2004 Nania ..... H01R 13/6599 439/680

* cited by examiner

*Primary Examiner* — Edwin A. Leon
(74) *Attorney, Agent, or Firm* — Alan D. Kamrath; Kamrath IP Lawfirm, P.A.

(57) ABSTRACT

A connecting structure for an earphone contains: a male connector and a female connector. The male connector includes a plug terminal and an insulation holder, the plug terminal has a locking portion adjacent to a bottom of the plug terminal, and the plug terminal has at least one protrusion extending outwardly from a peripheral side of the locking portion. The plug terminal is mounted in the insulation holder, and between the insulation holder and the plug terminal is defined an inserting groove. The female connector includes an insertion seat and a body. The body has a fixing portion inserted into the inserting groove, and the fixing portion has at least one alignment orifice corresponding to the at least one protrusion. The insertion seat is fixed in the body to electrically connect with the plug terminal.

10 Claims, 4 Drawing Sheets

CONNECTING STRUCTURE FOR EARPHONE

BACKGROUND OF THE INVENTION

1. Field of the Invention

The present invention relates to a connecting structure for an earphone which connects a male connector with a female connector in a locking manner.

2. Description of the Prior Art

A conventional earphone connector is connected with a connection holder on 3C equipment. A plug terminal of the earphone connector is inserted into an insertion seat of the connection holder, such that the plug terminal electrically conducts with a terminal of the insertion seat to transmit audio. Since the terminal of the insertion seat is flexible, since a contacting portion retains with the plug terminal, and when the plug terminal inserts into the insertion seat, it is fixed. When desiring to remove the plug terminal, it is manually pulled from the insertion seat with a gentle pull force.

However, it is easy to remove the plug terminal from the insertion seat while pulling a connecting wire unintentionally, thus stopping audio transmission.

Furthermore, another plug terminal suitable for a smart phone is mounted on an insertion seat of the smart phone to hang the smart phone. Thus, it is easy to drop the smart phone on the ground while pulling the plug terminal with force.

The present invention has arisen to mitigate and/or obviate the afore-described disadvantages.

SUMMARY OF THE INVENTION

The primary objective of the present invention is to provide a connecting structure of an earphone which contains a male connector rotated to not align at least one protrusion with at least one alignment orifice, so that a locking portion contacts with a fixing portion to avoid a removal of the male connector and the female connector.

Another objective of the present invention is to provide a connecting structure of an earphone in which a plug terminal is electrically connected with an insertion seat by ways of the at least one protrusion of the male connector and the at least one alignment orifice of the female connector.

Accordingly, a connecting structure of an earphone provided by the present invention contains a male connector and a female connector.

The male connector includes a plug terminal and an insulation holder. The plug terminal has a locking portion adjacent to a bottom of the plug terminal, and the plug terminal has at least one protrusion extending outwardly from a peripheral side of the locking portion. The plug terminal is mounted in the insulation holder, and between the insulation holder and the plug terminal is defined an inserting groove.

The female connector includes an insertion seat and a body. The body has a fixing portion inserted into the inserting groove, and the fixing portion has at least one alignment orifice corresponding to the at least one protrusion. The insertion seat is fixed in the body to electrically connect with the plug terminal.

Preferably, the male connector further includes a first connection wire for electrically connecting with the plug terminal.

Preferably, the female connector further includes at least one second connection wire for electrically connecting with the insertion seat.

Preferably, the fixing portion has an abutting face defined in an accommodation slot in which the locking portion is located.

Preferably, the locking portion has a contacting plane formed therein to contact with the abutting face.

Preferably, a height of the accommodation slot is greater than a thickness of the locking portion.

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1:
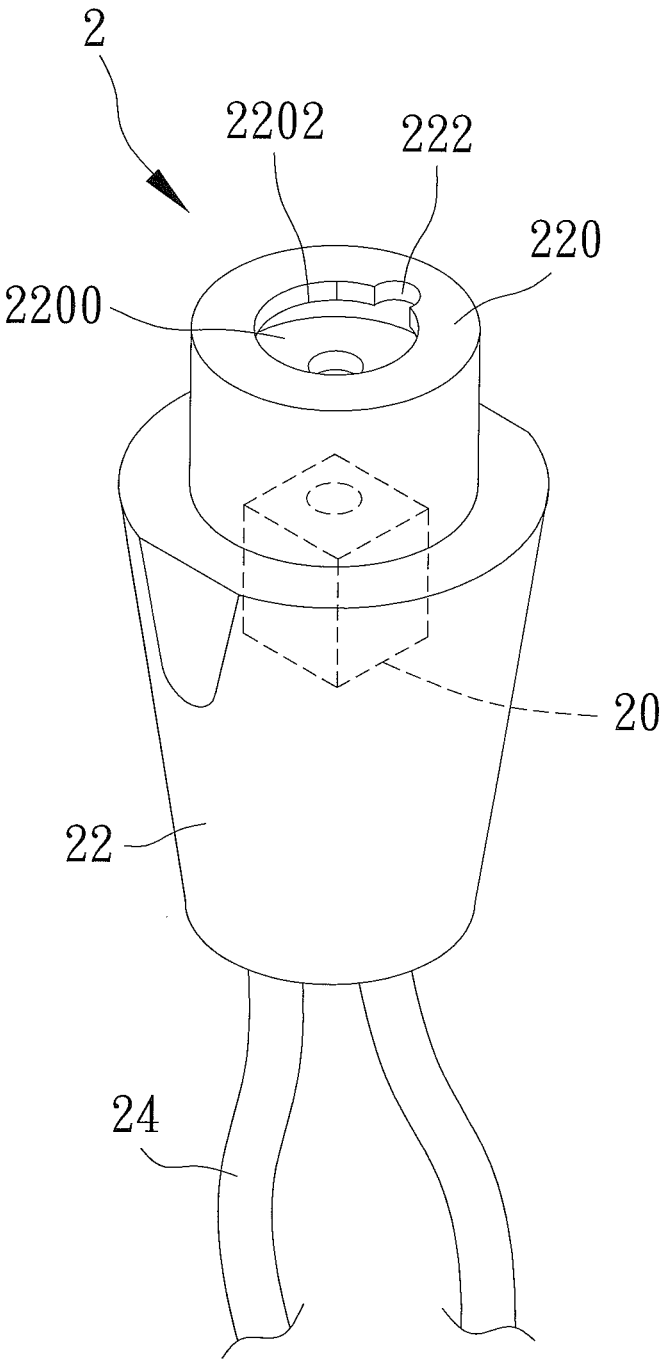
FIG. 1 is a perspective view showing the assembly of a female connector of a connecting structure of an earphone connector in accordance with a preferred embodiment of the present invention.
Figure 2:
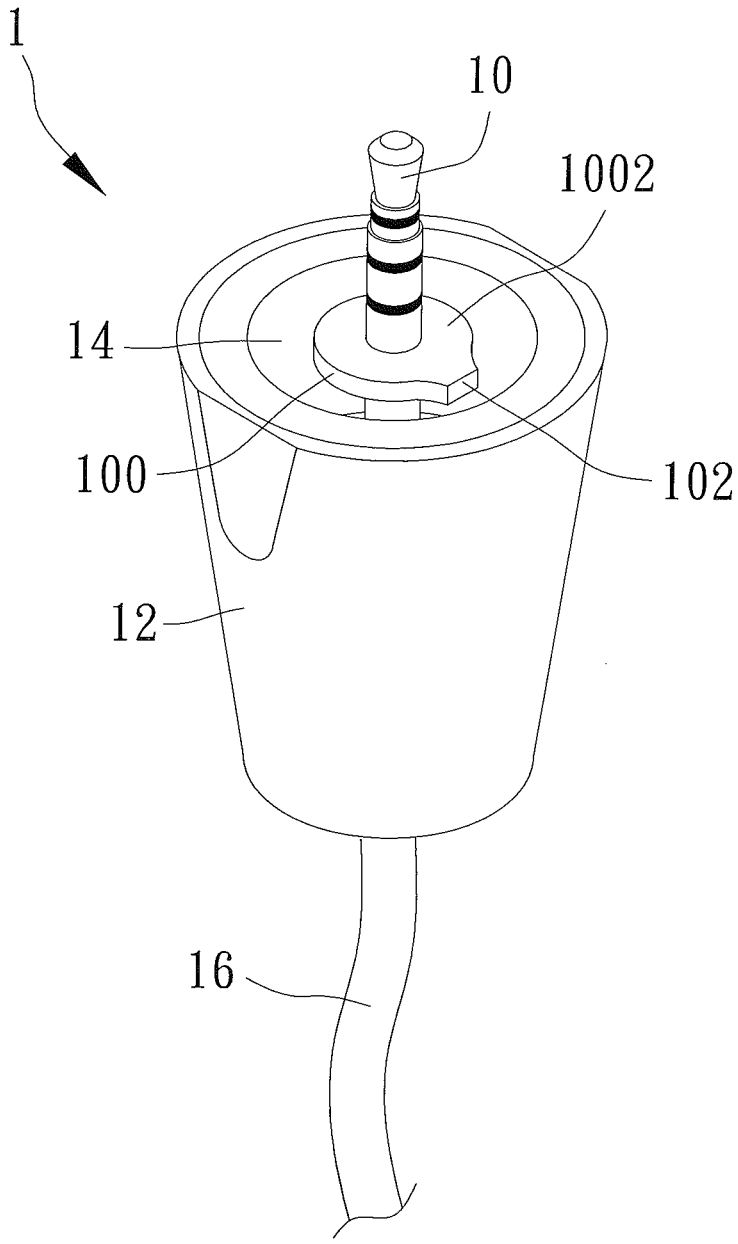
FIG. 2 is a perspective view showing the assembly of a male connector of the connecting structure of the earphone connector in accordance with the preferred embodiment of the present invention.

With reference to FIGS. 1 and 2, a connecting structure for an earphone according to a preferred embodiment of the present invention comprises a male connector 1 and a female connector 2 which are coupled together. The male connector 1 includes a plug terminal 10 and an insulation holder 12. The plug terminal 10 has a locking portion 100 adjacent to a bottom of the plug terminal 10 and has at least one protrusion 102 extending outwardly from a peripheral side of the locking portion 100. The plug terminal 10 is mounted in the insulation holder 12, and between the insulation holder 12 and the plug terminal 10 is defined an inserting groove 14. The female connector 2 includes an insertion seat 20 and a body 22. The body 22 has a fixing portion 220 inserted into the inserting groove 14, and the fixing portion 220 has at least one alignment orifice 222 corresponding to the at least one protrusion 102. The insertion seat 20 is fixed in the body 22 to electrically connect with the plug terminal 10. The male connector 1 further includes a first connection wire 16 for electrically connecting with the plug terminal 10, and the female connector 2 further includes at least one second connection wire 24 for electrically connecting with the insertion seat 20.

Figure 3:
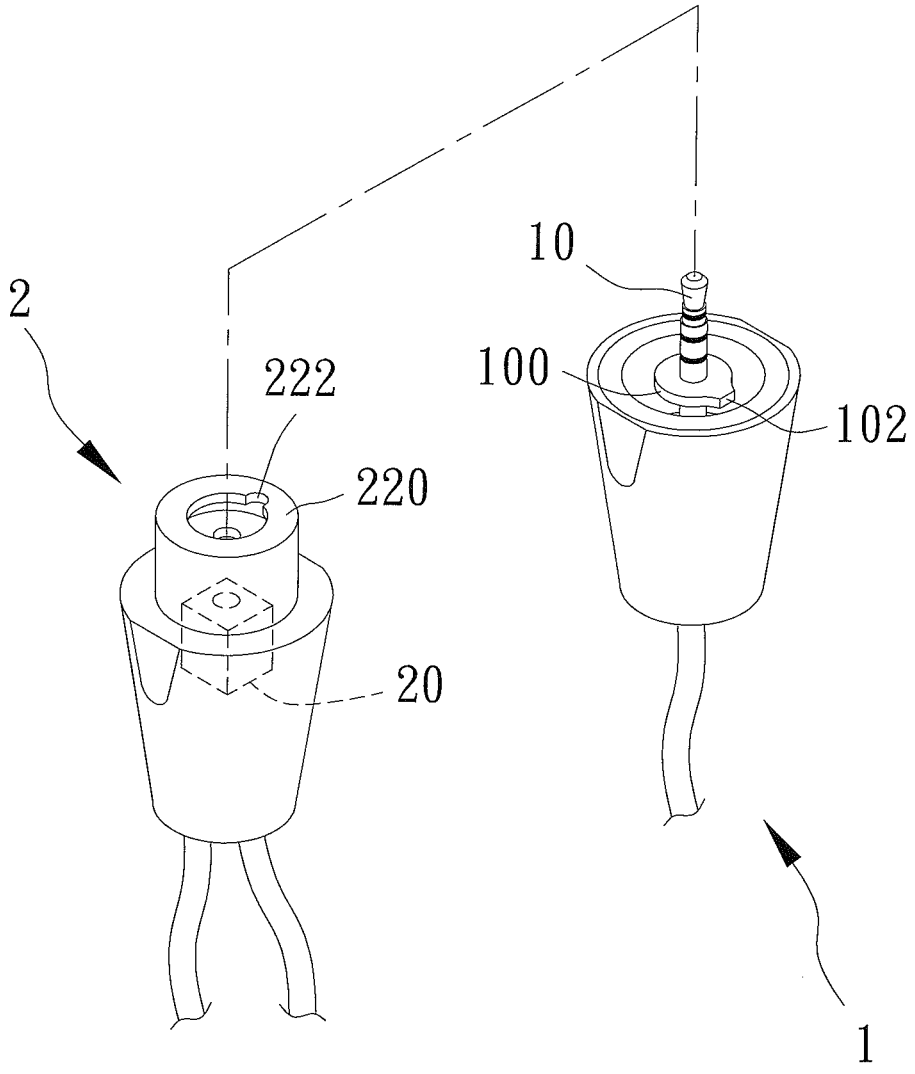
FIG. 3 is a perspective view showing the operation of the connecting structure of the earphone connector in accordance with the preferred embodiment of the present invention.
Figure 4:
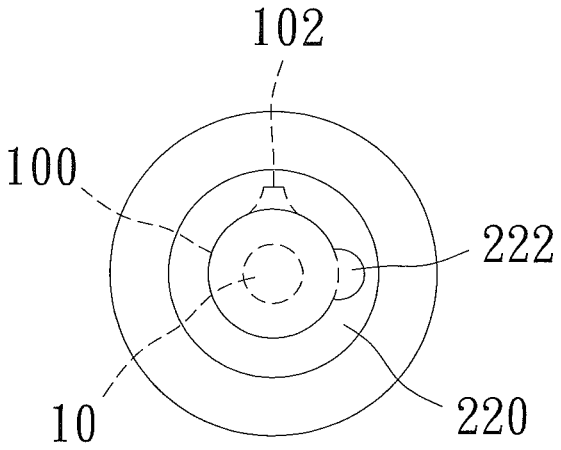
FIG. 4 is a plan view showing the operation of the connecting structure of the earphone connector in accordance with the preferred embodiment of the present invention.

Referring further to FIGS. 3 and 4, in use, the at least one protrusion 102 of the male connector 1 is aligned with the at least one alignment orifice 222 of the female connector 2, and the fixing portion 220 is inserted into the inserting groove 14, such that the locking portion 100 is located at an accommodation slot 2200 of the fixing portion 220. Due to the fixing portion 220 having an abutting face 2202 defined in the accommodation slot 2200 thereof, the locking portion 100 has a contacting plane 1002 formed therein, the contacting plane 1002 contacts with the abutting face 2202, and a height of the accommodation slot 2200 is greater than a thickness of the locking portion 100. Hence, the male connector 1 is electrically in connection with the female connector 2, and the contacting plane 1002 latches the abutting face 2202 tightly to avoid a removal of the male connector 1 and the female connector 2.

While various embodiments in accordance with the present invention have been shown and described, it is clear to those skilled in the art that further embodiments may be made without departing from the scope of the present invention.

What is claimed is:

1. A connecting structure for an earphone comprising:

a male connector including a plug terminal and an insulation holder, with the plug terminal having a locking portion connected adjacent to a bottom of the plug terminal and spaced from the insulation holder, with the locking portion having an annular peripheral side radially spaced from the plug terminal, with at least one protrusion extending radially outwardly from the annular peripheral side of the locking portion, wherein the plug terminal is mounted in the insulation holder, and between the insulation holder and the locking portion is defined an inserting groove;

a female connector including an insertion seat and a body, with the body having a fixing portion inserted into the inserting groove, with the fixing portion having at least one alignment orifice corresponding to the annular peripheral side and the at least one protrusion, wherein the insertion seat is fixed in the body to receive and electrically connect with the plug terminal.

2. The connecting structure for the earphone as claimed in claim 1, wherein the male connector further includes a first connection wire for electrically connecting with the plug terminal.

3. The connecting structure for the earphone as claimed in claim 1, wherein the female connector further includes at least one second connection wire for electrically connecting with the insertion seat.

4. The connecting structure for the earphone as claimed in claim 1, wherein the fixing portion has an abutting face spaced from the insertion seat, with an accommodation slot defined intermediate the abutting face and the insertion seat, with the locking portion located in the accommodation slot and intermediate the abutting face and the insertion seat.

5. The quick connector structure of the air connector as claimed in claim 4, wherein the locking portion has a contacting plane formed therein opposite to the insertion holder and to contact with the abutting face.

6. The connecting structure for the earphone as claimed in claim 4, wherein a height of the accommodation slot parallel to the plug terminal is greater than a thickness of the locking portion parallel to the plug terminal.

7. The connecting structure for the earphone as claimed in claim 6, wherein the inserting groove has an annular wall of a size for slideably receiving the fixing portion, with the plug terminal and the locking portion located within and spaced from the annular wall.

8. The connecting structure for the earphone as claimed in claim 5, wherein the inserting groove has an annular wall of a size for slideably receiving the fixing portion, with the plug terminal and the locking portion located within and spaced from the annular wall.

9. The connecting structure for the earphone as claimed in claim 4, wherein the inserting groove has an annular wall of a size for slideably receiving the fixing portion, with the plug terminal and the locking portion located within and spaced from the annular wall.

10. The connecting structure for the earphone as claimed in claim 1, wherein the inserting groove has an annular wall of a size for slideably receiving the fixing portion, with the plug terminal and the locking portion located within and spaced from the annular wall.

* * * * *